US005392202A

United States Patent [19]

Herron

[11] Patent Number: 5,392,202

[45] Date of Patent: Feb. 21, 1995

[54] LOW PROFILE ILLUMINATED PUSH BUTTON

[75] Inventor: William L. Herron, Frederick, Md.

[73] Assignee: Fred M. Schildwachter & Sons, Inc., Bronx, N.Y.

[21] Appl. No.: 242,266

[22] Filed: May 13, 1994

[51] Int. Cl.[6] ..... F21V 33/00

[52] U.S. Cl. ..... 362/95; 362/24; 362/253; 362/276; 200/314

[58] Field of Search ..... 362/95, 253, 276, 800, 362/802, 24; 200/314; 340/330, 815.13

[56] References Cited

U.S. PATENT DOCUMENTS

| | | | |
|---|---|---|---|
| 2,802,082 | 8/1957 | Kalwo | 200/314 X |
| 3,590,234 | 6/1971 | Bartick | 362/802 X |
| 4,694,130 | 9/1987 | Kitzmann et al. | 200/314 |
| 5,036,441 | 7/1991 | Herron | 362/95 |
| 5,099,094 | 3/1992 | Torma et al. | 200/314 X |

*Primary Examiner*—Stephen F. Husar

*Attorney, Agent, or Firm*—Brooks Haidt Haffner & Delahunty

[57] ABSTRACT

An illuminated electrical push button switch has a pair of spring contacts secured in a plug-like body on either side of a miniature bulb. A flat top, metallic cup-shape, push button overlies the contacts, insulated therefrom by a sheet of electrical insulating material. The push button has a plurality of circumferentially spaced radially projecting fingers. A cylindrical shell with a radially inwardly directed flange fits over the plug-like body with a snug fit with the flange overlying the fingers of the push button to secure the push button to the body. A plurality of circumferentially spaced notches in the flange of the shell provide openings through which light emanating from the lamp can escape. The entire assembly has a low profile and is mounted by means of an adhesive. The assembly can be mounted directly on the building structure or it can be mounted with a decorative plate or the like interposed between the building and push button assembly.

14 Claims, 2 Drawing Sheets

FIG. 1
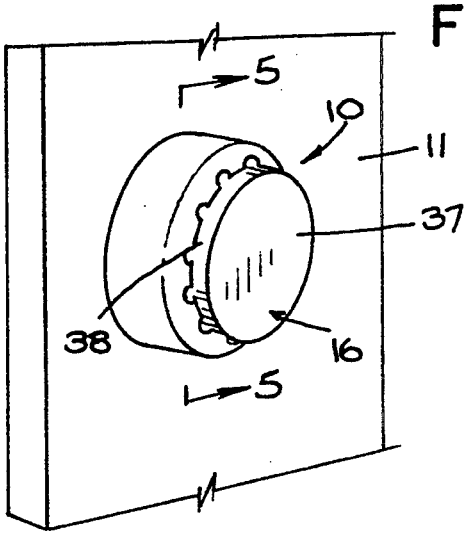
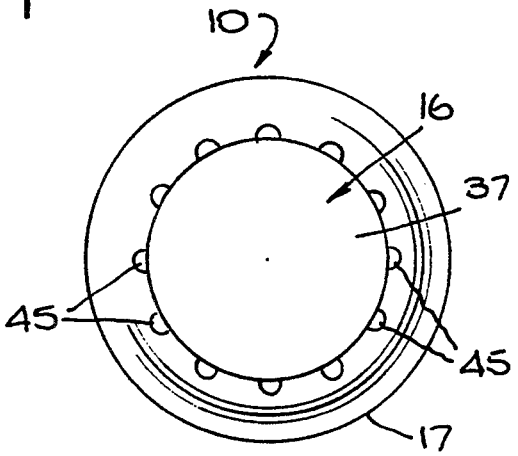
FIG. 2
FIG. 3
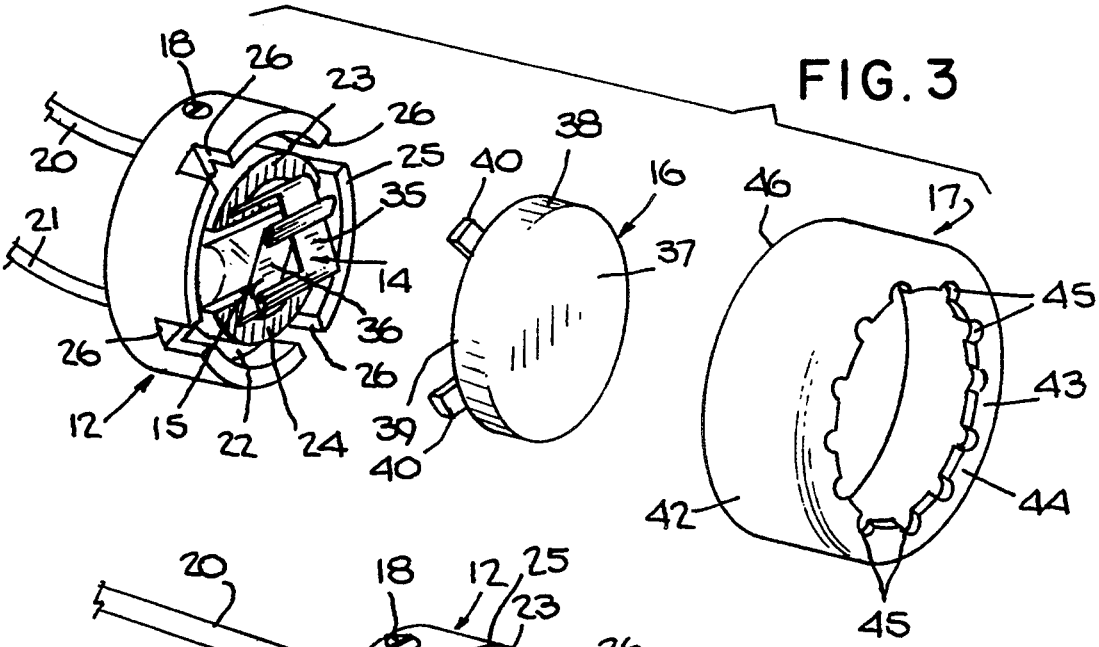
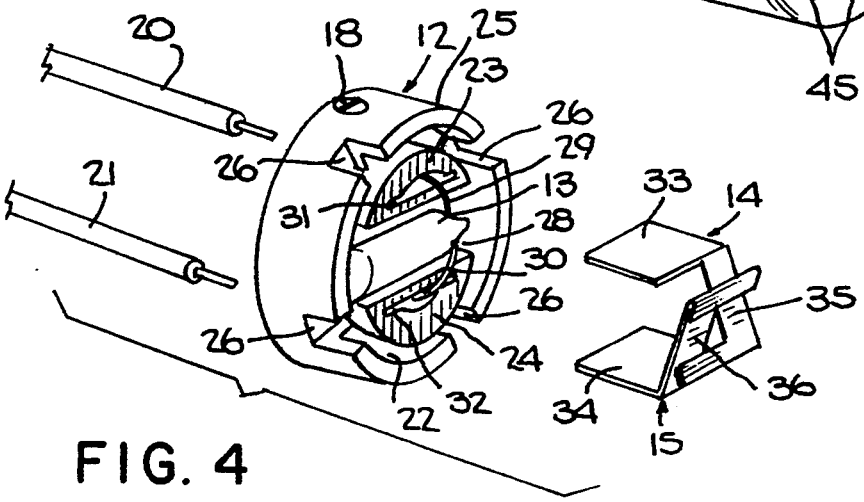
FIG. 4

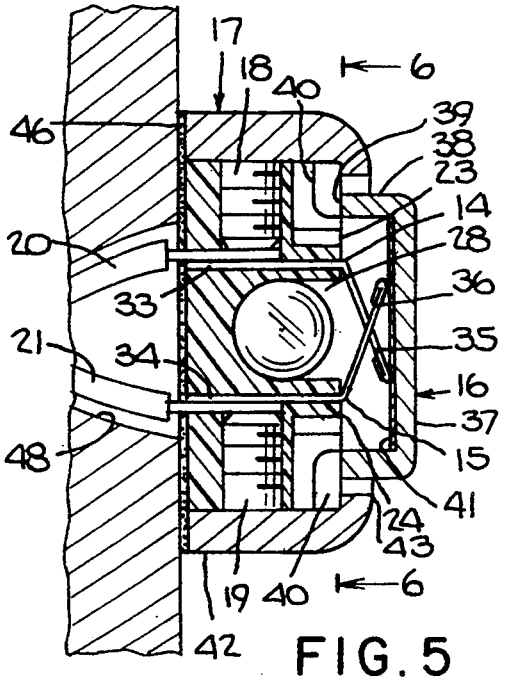
FIG. 5
FIG. 6
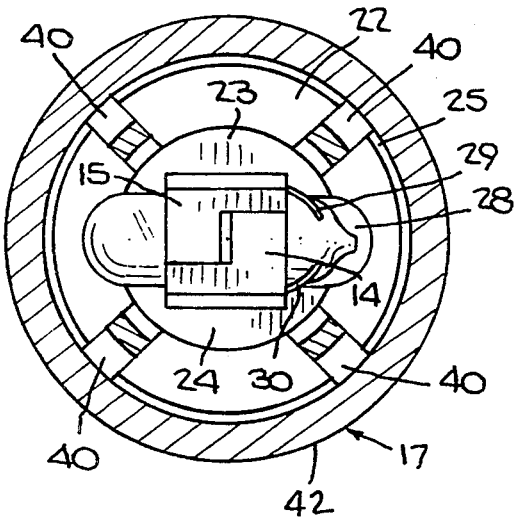
FIG. 8
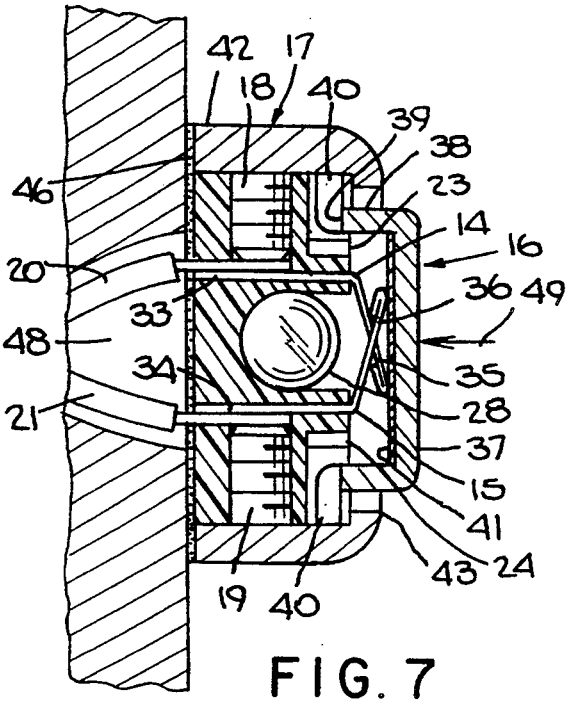
FIG. 7
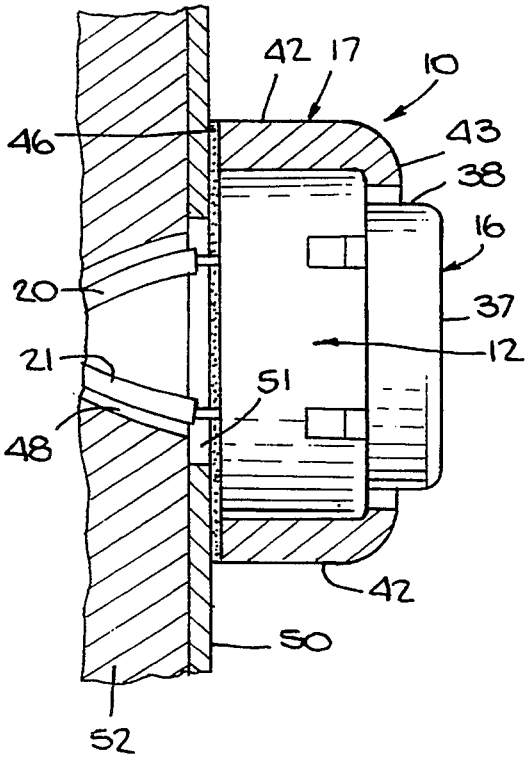

LOW PROFILE ILLUMINATED PUSH BUTTON

BACKGROUND OF THE INVENTION

The present invention relates to push button switch assemblies, and, more particularly, to illuminated push button switches commonly used in connection with door bells, chimes or the like.

Heretofore, push buttons of this type have been made with at least a dozen parts including a helical compression spring, contacts, screws, a bulb, a button and a housing. Both the cost of producing the individual parts and the cost of assembly have been higher than need be.

In my issued U.S. Pat. No. 5,036,441 there is described an illuminated electrical push button switch which has a pair of spring contacts secured in a housing on either side of a miniature bulb. The contacts have inclined bifurcated ends that bear resiliently against the underside of the push button. Depressing the button causes the bifurcated contact ends to deform elastically and come together making electrical contact. The pigtail leads for the bulb are sandwiched between the contacts and a block portion of the housing, all being held in place by a screw that also functions as a binding post for the external wire connection.

However, the heretofore known illuminated push button assemblies, if intended for surface mounting, have an elevated profile or require boring at least a $\frac{5}{8}''$ diameter counterbore in the building structure in order to accommodate either a threaded or longitudinally ribbed rear extension of the button assembly.

Therefore, it is an object of the present invention to provide an illuminated push button switch of much simpler and economic construction.

It is a further object of the invention to produce a low profile illuminated push button switch that can be installed with a minimum of preparation of the structural surface on which the switch is to be mounted or, in some installations, no preparation of the mounting surface.

Various other objects will become apparent after reading the ensuing description.

SUMMARY OF THE INVENTION

In accordance with the present invention there is provided an illuminated low profile push button switch assembly comprising in combination a plug-like body, an electrically energizeable light emitting device, a pair of spaced apart electrically conductive spring metal contacts, a push button, a shell for joining the push button to the body, and means for separately connecting to each of the contacts an external electrical conductor. The contacts each have a tang secured within the body in electrical contact with means for establishing an electrical connection to the light emitting device, and a flexible portion extending from each of the tangs and projecting from the body for engagement by the push button. The push button is cup-shape and disposed for movement relative to the body with the flexible portions of the contacts bearing against the push button within its confines exerting a spring return force upon the push button opposing depression of the push button. The body is configured to permit at least partial telescoping movement between the push button and the body with the push button, upon depression, causing the flexible portions of the contacts to flex and engage closing an electrical circuit shunting the light emitting device and completing a circuit for an external voltage source through the means for connecting to each contact an external electrical conductor. The shell has a skirt portion surrounding the body and has a radially inwardly directed flange portion which overlaps the body and terminates at an edge that closely surrounds the push button. Means are provided for cooperation between the shell and the push button for securing the push button to the body, and light transmissive means are provided for enabling light emanating from the light emitting device to escape from the push button assembly.

BRIEF DESCRIPTION OF THE DRAWINGS

The invention will be better understood after reading the following detailed description of the presently preferred embodiment thereof with reference to the appended drawings in which:

FIG. 1 is a perspective view, showing an installation of a push button assembly embodying the present invention on a building structure shown only suggestively;

FIG. 2 is a top plan view of the push button assembly of FIG. 1;

FIG. 3 is an exploded view in perspective of the assembly of FIGS. 1 and 2 showing details of the shell, push button, and body sub-assembly;

FIG. 4 is an exploded view in perspective of the body sub-assembly of FIG. 3 showing details of the contacts, light emitting device and body;

FIG. 5 is an enlarged sectional view taken along the line 5—5 in FIG. 1;

FIG. 6 is a cross-sectional view taken along the line 6—6 in FIG. 5;

FIG. 7 is a view similar to FIG. 5 but showing the push button in depressed condition; and FIG. 8 is a view similar to FIG. 5 but only partially sectioned showing the push button and body in side elevation while illustrating a modified mode of installation wherein a decorative plate or the like is interposed between the building and the push button assembly.

The same reference numerals are used throughout the various figures of the drawings to designate the same or similar parts.

DETAILED DESCRIPTION OF THE PRESENTLY PREFERRED EMBODIMENT

Referring to the drawings, the illuminated push button assembly is designated generally by the reference numeral 10. In FIG. 1 it is shown as it would appear when installed, the underlying building structure being shown only suggestively at 11. The button assembly 10 is of low profile and, as will become evident from the following description, can be mounted merely by use of a suitable adhesive.

The principle components of the push button assembly 10 are shown in FIGS. 3 and 4. They consist of a plug-like body 12, an electrically energizeable light emitting device in the form of a miniature lamp 13, a pair of spaced apart electrically conductive spring metal contacts, 14 and 15, a push button 16, a shell 17 for joining the push button 16 to the body 12, and a pair of screws, 18 and 19, the screws being best seen in FIGS. 5 and 7, only one of which can be seen in FIGS. 3 and 4, for separately connecting to each of the contacts 14 and 15 an external electrical conductor 20 and 21, respectively.

The body 12 can be molded from a plastic, such as an acetal copolymer sold under the trademark "CEL- CON" by Hoechst Celanese Corp., Somerville, N.J. Other suitable plastics such as those marketed under the "DELRIN" and "LEXAN" trademarks can also be used if desired. As shown in the drawings, the body 12 is in the form of a right circular cylinder having a circular channel 22, formed in one end which separates a central island, subdivided into segments 23 and 24, from a thin radially outer wall 25. The wall 25 is provided with four notches 26 spaced equidistantly circumferentially. The miniature lamp 13 is disposed in the space 28 between the segments 23 and 24. The lamp 13 is of a known type and generally contains a filament energizeable by the relatively low-voltage customarily used with a bell or chime. The lamp 13 has pigtail leads 29 and 30. As shown in FIGS. 4, 5 and 7, the island segments are provided with respective slots 31 and 32 which are of a size sufficient to accommodate the respective contacts 14 and 15.

The spring contacts 14 and 15 are identically constructed having respective tang portions 33 and 34 from which extend respective L-shape flexible portions 35 and 36. The contacts 14 and 15 are disposed facing one another as seen in FIG. 4 and inserted into the slots 31 and 32 after insertion in the respective slot of the leads 29 and 30 of lamp 13. As the tang portions 33 and 34 are introduced into the corresponding slot 31 or 32 the tang encounters the corresponding lamp lead 29 or 30 carrying the lead downward into the slot so as to capture the corresponding lead 29 or 30 between tang 33 or 34 and the wall of the slot 31 or 32. The pair of screws 18 and 19 are now loosely installed in the tapped holes located to position the screws at right angles to the respective slot 31 or 32 and associated contact tang 33 or 34.

As best seen in FIGS. 5 and 7, two small bores are provided extending from the base of the body 12 inward adjacent one side of the corresponding slot 31 or 32 for receiving the end of the electrical conductor 20 or 21 alongside the tang 33 or 34 where the conductor 20 or 21 can be clamped against the corresponding tang by tightening the corresponding screw 18 or 19.

The push button 16 is cup-shape having in this embodiment a substantially flat top wall 37 and a cylindrical side wall 38 which is joined at one end to the top wall 37 and terminates at its opposite end in an edge 39 from which project radially outwardly four circumferentially spaced fingers 40. The dimensions of the side wall 38 of the push button 16 correspond to those of the channel 22 in the body 12 so that the wall 38 can enter the channel 22 with a loose fit.

The push button 16 is assembled to the body 12 after the lamp 13 and contacts 14 and 15 are installed. The fingers 40 are aligned with the notches 26 with which they mate with a loose fit. The projection of the fingers 40 from the wall 38 is such that upon assembly of the push button 16 to the body 12 the fingers 40 will not project beyond the outer surface of the body 12.

As seen in FIG. 5, a disk 41 of insulating material, for example a thin piece of a phenolic material, is disposed over the inner surface of the top wall 37 of the push button 16 to insulate the contacts 14 and 15 from the metal of the push button 16. After assembling the push button 16 to the body 12, the shell 17 is assembled.

The shell 17 has a cylindrical skirt portion 42 that telescopes over the body 12 with a snug fit and has a radially inwardly directed flange portion 43 which overlaps the wall 25 of the body 12 and terminates at an edge 44 that closely surrounds the wall 38 of the push button 16. The flange portion 43 also overlaps the fingers 40 of the push button for securing the push button 16 to the body 12.

In order to permit escape of the light emitted by the lamp 13, a series of circumferentially spaced notches 45 are formed in the edge 44 of the flange portion 43 of the shell 17.

When the body 12 is inserted within the shell 17 the bottom edge 46 of the skirt portion 42 of the shell 17 comes into planar alignment with the bottom surface of the body 12. This provides a suitable flat surface for applying an adhesive for adhesively bonding the push button assembly 10 to the underlying woodwork or building structure. Any suitable adhesive can be employed including that incorporated in double sided tape.

Because of the construction of the push button assembly 10, installation is greatly facilitated. The electrician need only bring out the usual bell wire pair through a passage just large enough to accommodate the wire. As shown in FIGS. 5 and 7, the exposed end of the wire passage is flared out at 48 just sufficient to allow for the individual conductors to spread apart a distance equal to the spacing between the contacts 14 and 15. With the shell 17 removed, the ends of the conductors 20 and 21 are inserted into the respective holes in the body 12 and the screws 18 and 19 are tightened. The body 12 is then inserted into the shell 17, whereupon with the appropriate adhesive in place, the assembly is pushed into place, the wires 20 and 21 backing into the passage in the building structure.

Operation of the push button assembly 10 is shown in FIG. 7. When the push button 16 is depressed in the direction of the arrow 49, the flexible portions 35 and 36 of the contacts 14 and 15 are depressed until the overlapping ends of the portions 35 and 36 engage one another to close the circuit. As with the push button in my issued patent, closing of the contacts provides a shunt around the lamp 13, extinguishing the lamp but completing a circuit for the external bell, chime or the like to which the switch assembly is connected.

Due to the method of attaching the instant push button assembly it is readily adaptable to the interpositioning of a decorative plate or the like between the assembly 10 and the building structure. This is illustrated by way of example in FIG. 8. A decorative plate 50, provided with a slot 51 to accommodate the spread of the wires 20 and 21, is disposed between the building wall 52 and the assembly 10.

Although not shown in the drawings, if the decorative plate has sufficient thickness for the wires 20 and 21 to spread within the thickness dimension of the plate, flaring of the mouth of the passage through the building wall can be avoided.

Of course, if desired, the body 12 can be extended with the usual ⅜" diameter plug end, threaded or ribbed for conventional installation.

Having described the invention with reference to the presently preferred embodiment thereof, it should be apparent that various changes in construction can be effected without departing from the true spirit of the invention as defined in the appended claims.

What is claimed is:

1. An illuminated low profile push button switch assembly comprising in combination a plug-like body, an electrically energizeable light emitting device, a pair of spaced apart electrically conductive spring metal contacts, a push button, a shell for joining said push button to said body, and means for separately connecting to each of said contacts an external electrical conductor, said contacts each having a tang secured within said body in electrical contact with means for establishing an electrical connection to said light emitting device, and a flexible portion extending from each of said tangs and projecting from said body for engagement by said push button, said push button is cup-shape and disposed for movement relative to said body with said flexible portions of said contacts bearing against said push button within its confines exerting a spring return force upon said push button opposing depression of said push button, said body is configured to permit at least partial telescoping movement between said push button and said body with said push button, upon depression, causing said flexible portions of said contacts to flex and engage closing an electrical circuit shunting said light emitting device and completing a circuit for an external voltage source through said means for connecting to each contact an external electrical conductor, said shell has a skirt portion surrounding said body and has a radially inwardly directed flange portion which overlaps said body and terminates at an edge that closely surrounds said push button, means are provided for cooperation between said shell and said button for securing said push button to said body, and light transmissive means are provided for enabling light emanating from said light emitting device to escape from said push button assembly.

2. An illuminated low profile push button switch assembly according to claim 1, wherein said light transmissive means comprises one or more openings formed between said shell and said push button.

3. An illuminated low profile push button switch assembly according to claim 2, wherein said openings are provided by circumferentially spaced notches formed in said edge of said flange portion of said shell.

4. An illuminated low profile push button switch assembly according to claim 3, wherein said push button is metallic with a cylindrical side wall joined at one end to a top wall and terminating at its opposite end in an edge from which project radially outwardly a plurality of circumferentially spaced fingers, and said fingers on said push button extend radially beyond and under said edge of said shell flange portion providing said means for securing said push button to said body.

5. An illuminated low profile push button switch assembly according to claim 4, wherein said body is provided with a separate recess in corresponding alignment with each of said fingers for receiving the corresponding one of said fingers upon depression of said push button.

6. An illuminated low profile push button switch assembly according to claim 5, wherein said body has a side wall shaped and dimensioned to make a snug fit within said skirt portion of said shell.

7. An illuminated low profile push button switch assembly according to claim 1, wherein said push button is metallic with a cylindrical side wall joined at one end to a top wall and terminating at its opposite end in an edge from which project radially outwardly a plurality of circumferentially spaced fingers, and said fingers on said push button extend radially beyond and under said edge of said shell flange portion providing said means for securing said push button to said body.

8. An illuminated low profile push button switch assembly according to claim 7, wherein said body is provided with a separate recess in corresponding alignment with each of said fingers for receiving the corresponding one of said fingers upon depression of said push button.

9. An illuminated low profile push button switch assembly according to claim 8, wherein said body has a side wall shaped and dimensioned to make a snug fit within said skirt portion of said shell.

10. An illuminated low profile push button switch assembly according to claim 1, wherein said body has a side wall shaped and dimensioned to make a snug fit within said skirt portion of said shell.

11. An illuminated low profile push button switch assembly according to claim 10, wherein said light transmissive means comprises one or more openings formed between said shell and said push button.

12. An illuminated low profile push button switch assembly according to claim 11, wherein said openings are provided by circumferentially spaced notches formed in said edge of said flange portion of said shell.

13. An illuminated low profile push button switch assembly according to claim 6, wherein said body is formed from an electrically non-conductive plastic resin, said shell is formed from a metallic material, and a layer of electrically insulating material is disposed within said cup-shape push button in contact with said top wall and separating said metallic pushbutton from said electrically conductive contacts.

14. An illuminated low profile push button switch assembly according to claim 13, wherein the exposed surface of said body and the free end of said skirt portion of said shell lie on a substantially common plane and are provided with adhesive means for mounting the push button assembly.

* * * * *